United States Patent [19]

Shikama et al.

[11] Patent Number: 4,504,817

[45] Date of Patent: Mar. 12, 1985

[54] DEMAGNETIZING CIRCUIT USING A PTC THERMISTOR DEVICE

[75] Inventors: Takashi Shikama, Yokaichi; Tomoyuki Yamamoto, Omihachiman; Yuichi Takaoka, Yokaichi, all of Japan

[73] Assignee: Murata Manufacturing Co., Ltd., Japan

[21] Appl. No.: 365,480

[22] Filed: Apr. 5, 1982

[30] Foreign Application Priority Data

Apr. 13, 1981 [JP] Japan ..... 56-53695[U]

[51] Int. Cl.[3] ..... H01C 7/02

[52] U.S. Cl. ..... 338/23; 315/8; 361/150

[58] Field of Search ..... 338/22 R, 225 D, 23, 338/220; 315/8; 361/150

[56] References Cited

U.S. PATENT DOCUMENTS

| | | | |
|---|---|---|---|
| 3,492,543 | 1/1970 | Muranaga | 361/150 |
| 3,842,188 | 10/1974 | Petersen | 338/220 X |
| 3,914,727 | 10/1975 | Fabricius | 338/22 R |
| 4,024,427 | 5/1977 | Belhomme | 338/23 X |
| 4,357,590 | 11/1982 | Belhomme | 338/23 |

*Primary Examiner*—C. L. Albritton

*Attorney, Agent, or Firm*—Ostrolenk, Faber, Gerb & Soffen

[57] ABSTRACT

A PTC thermistor device includes three PTC thermistors aligned and disposed in a heat transmission relation to each other such that the center PTC thermistor provides heat to the other PTC thermistors which are so connected as to define a part of path for the demagnetizing current. The two PTC thermistors positioned on the opposite sides of the center PTC thermistor increase their temperature rapidly so that a rapid and effective attenuation of demagnetizing current can be obtained.

6 Claims, 7 Drawing Figures

DEMAGNETIZING CIRCUIT USING A PTC THERMISTOR DEVICE

BACKGROUND OF THE INVENTION

1. Field of the Invention

The present invention relates to a demagnetizing circuit including a positive temperature coefficient (PTC) thermistor device employed in association with a cathode ray tube, e.g., in a color television receiver.

2. Description of the Prior Art

Generally, in an electronic devices employing a cathode ray tube, there is provided a demagnetizing circuit for eliminating the magnetic field produced around the cathode ray tube.

A typical PTC thermistor device 5 of the above described type is shown in FIG. 1, which comprises a positive temperature coefficient (PTC) thermistor 1 formed in the shaped of plate, a pair of electrodes 1*a* and 1*b* deposited on opposite faces of the PTC thermistor 1, a pair of lead terminals 2 and 3 made of metal and having their one ends 2*a* and 3*a* so bent as to provide a spring effect, and a casing 4 made of electrically non-conductive material. The lead terminals 2 and 3 are supported by the casing 4 and are positioned as to locate their bent ends 2*a* and 3*a* inside the casing 4. The PTC thermistor 1 is provided in the casing 4 and held tightly between the bent ends 2*a* and 3*a* for effecting an electrical connection of the electrodes 1*a* and 1*b* with the terminals 2 and 3, respectively.

FIG. 2 shows a demagnetizing circuit including the thermistor device 5 described above, a demagnetizing coil 6, a power switch 7 and a demagnetizing power source 8, which are connected in series to define a closed loop. The demagnetizing coil 6 is positioned close to an element which carries a residual magnetism.

When the switch 7 is turned on, an a.c. current (referred to as a demagnetizing current) flows through the PTC thermistor device 5, resulting in an gradual increase of temperature of the PTC thermistor 1. Thus, the resistance of the PTC thermistor 1 gradually increases and, as a result, the demagnetizing current attenuates, as shown by a waveform A in FIG. 5. The demagnetizing current flowing through the coil 6 excites a gradual decreasing a.c. magnetic field, which serves to remove the residual magnetism in the element positioned close to the coil 6.

Although the PTC thermistor device 5 shown in FIG. 1, and its circuit shown in FIG. 2 are simple in construction, the demagnetizing current remains to a considerable degree after 3 seconds and even after 3 minutes from the turning-on of the switch 7 as shown in a chart 1 below.

CHART 1

| | Initial current | Current 3 sec. later | Current 3 min. later |
|---|---|---|---|
| FIG. 2 circuit | 10 A | 70 mA | 30 mA |
| FIG. 4 circuit | 10 A | 25 mA | 2 mA |

It is to be noted that the results shown in the chart 1 is obtained when a.c. 100 volt is supplied from the demagnetizing power source 8.

The remaining demagnetizing current results in an incomplete demagnetization of the element to be demagnetized and, thus it adversely produces a distortion of a picture on the cathode ray tube.

In order to reduce the remaining demagnetizing current, an improved PTC thermistor device 17, as shown in FIG. 3, has been proposed. The PTC thermistor device 17 shown in FIG. 3 comprises two PTC thermistors 11 and 12, in which the PTC thermistor 11 is deposited with electrodes 11*a* and 11*b* and the PTC thermistor 12 is deposited with electrodes 12*a* and 12*b*. The PTC thermistor 11 and 12 are positioned on opposite sides of a terminal plate 13 inside a casing 16. The terminal plate 13 has a lead portion 18 extending outwards from the casing 16. The PTC thermistor 11 is tightly held between the terminal plate 13 and a bent portion 14*a* of a lead terminal 14, and the PTC thermistor 12 is tightly held between the terminal plate 13 and a bent portion 15*a* of a lead terminal 15, in a similar manner to that described above.

FIG. 4 shows a demagnetizing circuit employing the PTC thermistor device 17 described above. As shown in FIG. 4, the demagnetizing power source 8 and the switch 7 are connected in series between the lead terminals 14 and 18, and the demagnetizing coil 6 is connected between the terminal leads 14 and 15.

When the switch 7 is turned on, an a.c. current flows through the PTC thermistor 11 and, at the same time, another a.c. current, i.e., the demagnetizing current, flows through the PTC thermistor 12 resulting in an increase of the temperature of the PTC thermistor 11 and 12. The heat generated from the PTC thermistor 11 is transferred to the PTC thermistor 12 through the terminal plate 13. Thus, the resistance of the PTC thermistor 12 increases rapidly and, as a result, the demagnetizing current attenuates more rapidly than the previous circuit of FIG. 2, as indicated in the chart 1. More particularly, after 3 seconds from the time the switch is closed, the demagnetizing current attenuates to 25 mA, and after 3 minutes from the same, it attenuates to 2 mA.

Although these figures show a great improvement, they are not sufficient for a delicate device such as a cathode ray tube.

In order to further attenuate the demagnetizing current, one approach is to further increase the temperature of the PTC thermistor 12, through which the demagnetizing current flows. To meet this end, one may attempt to reduce the size of the PTC thermistor device 17 to reduce the heat dissipation area. However, such a small size demagnetizing device 17 has the disadvantage that the current peaks are dropped by a considerably great degree B, shown in FIG. 5, to cause an undesirable magnetization.

SUMMARY OF THE INVENTION

The present invention has been developed with a view to substantially solving the above described disadvantages and has for its essential object to provide an improved PTC thermistor device which can attenuate the demagnetizing current to a very low level.

It is also an important object of the present invention to provide an improved PTC thermistor device wherein current levels between two neighboring current peaks are considerably small.

In accomplishing these and other objects, the PTC thermistor device, according to the present invention, comprises a first PTC thermistor having first and second flat faces, and first and second terminal plates held in contact with the first and second faces of the first PTC thermistor, respectively. A second PTC thermistor having first and second flat faces is provided such that the first flat face of the second PTC thermistor is held in contact with the first terminal plate, thus the first terminal plate is sandwiched between the first and second PTC thermistors. A third PTC thermistor having first and second flat faces is provided such that the first flat face of the third PTC thermistor is held in contact with the second terminal plate. Thus, the second terminal plate is sandwiched between the first and third PTC thermistors. A first terminal member is connected to the second flat face of the second PTC thermistor, and a second terminal member is connected to the second flat face of the third PTC thermistor. The PTC thermistor device according to the present invention further comprises means for holding the first, second, third PTC thermistors and the first and second terminal plates together.

BRIEF DESCRIPTION OF THE DRAWINGS

These and other objects and features of the present invention will become apparent from the following description taken in conjunction with a preferred embodiment thereof with reference to the accompanying drawings, throughout which like parts are designated by like reference numerals, and in which.

DESCRIPTION OF THE PREFERRED EMBODIMENT

Figure 6:
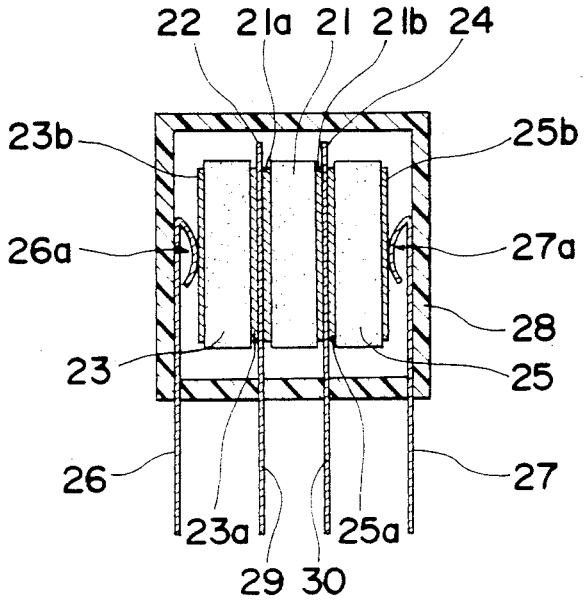
FIG. 6 is a cross-sectional view of a PTC thermistor device according to the present invention.

Referring to FIG. 6, a PTC thermistor device according to the present invention comprises three PTC thermistors 21, 23 and 25 having the same configuration as each other, and each formed by a PTC thermistor plate which has been sintered. The PTC thermistor 21 has a pair of electrodes 21*a* and 21*b* deposited on opposite flat faces thereof. Similarly, the PTC thermistor 23 has a pair of electrodes 23*a* and 23*b* on its opposite faces, and the PTC thermistor 25 has a pair of electrodes 25*a* and 25*b* on its opposite faces.

The PTC thermistor 21 positioned in the center is tightly held between a pair of terminal plates 22 and 24 such that the electrode 21*a* is held in contact with the terminal plate 22 and the electrode 21*b* is held in contact with the terminal plate 24. The terminal plates 22 and 24 are rigidly secured to a casing 28 made of electrically non-conductive material, such as synthetic resin.

The PTC thermistor 23 is positioned, when viewed in FIG. 6, on the left-hand side of the PTC thermistor 21, and is tightly held between the terminal plate 22 and a bent portion 26*a* of a lead terminal 26, such that the electrode 23*a* is tightly held in contact with the terminal plate 22 and the electrode 23*b* is tightly held in contact with the bent portion 26*a* of the lead terminal 26.

The PTC thermistor 25 is positioned on the right-hand side of the PTC thermistor 21, and is tightly held between the terminal plate 24 and a bent portion 27*a* of a lead terminal 27, such that the electrode 25*a* is tightly held in contact with the terminal plate 24 and the electrode 25*b* is tightly held in contact with the bent portion 27*a* of the lead terminal 27.

It is to be noted that the axis of the PTC thermistors 23, 21 and 25 are aligned with one other.

It is also to be noted that each of the bent portion 26*a* and 27*a* serves as a spring to urge the PTC thermistors 23, 21 and 25 together to ensure the electrical connection therebetween and also to ensure the heat transmission, particularly from the center PTC thermistor 21 to each of the PTC thermistors 23 and 25 through terminal plates 22 and 24, respectively.

In order to improve the above mentioned heat transmission, the terminal plates 22 and 24 are formed by a material having a high thermal conductivity, such as a phosphor bronze.

In contrast to this, the lead terminals 26 and 27 are preferably formed by a material having a low thermal conductivity, such as a stainless steel, to prevent the heat transmission from the PTC thermistors 23 and 25 to the casing 28.

The terminal plates 22 and 24 have terminal legs 29 and 30, respectively, extending outwardly from the casing 28. Furthermore, the lead terminals 26 and 27 have their end portions, remote from the bent portions 26*a* and 27*a*, extending outwardly from the casing 28.

Figure 7:
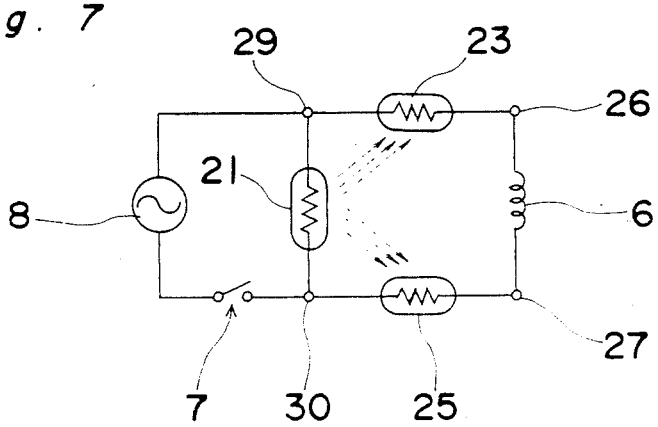
FIG. 7 is a circuit diagram showing an demagnetizing circuit employing the device of FIG. 6.

Referring to FIG. 7, there is shown a demagnetizing circuit employing the PTC thermistor device of the present invention. A demagnetizing coil 6 is connected between the lead terminals 26 and 27, and a switch 7 and an a.c. power source 8 are connected in series between the terminal legs 29 and 30.

Figure 1:
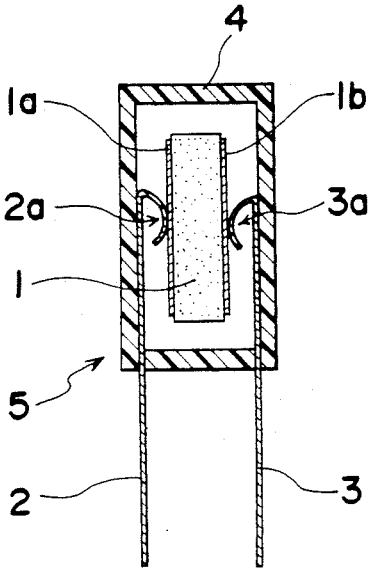
Fig. 1 Prior Art
FIG. 1 is a cross-sectional view of a PTC thermistor device according to the prior art.
Figure 2:
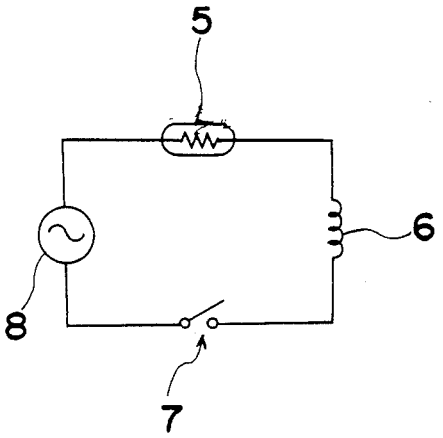
Fig. 2 Prior Art
FIG. 2 is a circuit diagram showing an demagnetizing circuit employing the device of FIG. 1.
Figure 3:
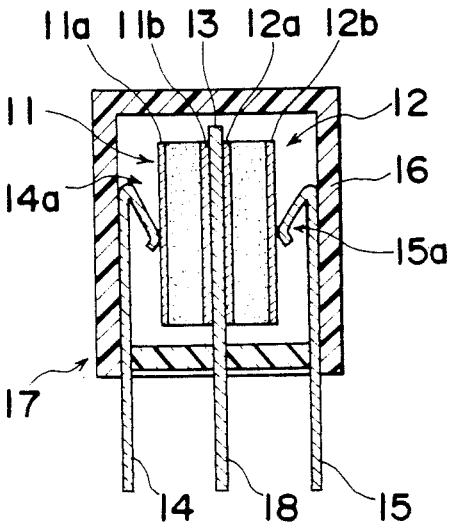
Fig. 3 Prior Art
FIG. 3 is a cross-sectional view of another PTC thermistor device according to the prior art.

When the switch 7 is turned on, an a.c. current flows through the center PTC thermistor 21 and, at the same time another a.c. current (demagnetizing current) flows through the PTC thermistors 23, 25 and the coil 6. By the first mentioned a.c. current, the center PTC thermistor 21 generates heat which is effectively transferred to the PTC thermistors 23 and 25 on its opposite sides through the terminal plates 22 and 24. Therefore, the heat generated from the center PTC thermistor 21 is utilized with a high efficiency. As a result of the second mentioned a.c. current (demagnetizing current), the PTC thermistors 23 and 25 generate heat. Therefore, the PTC thermistors 23 and 25 are heated by the heat they generate themselves and by the heat transferred to them from the center PTC thermistor 21. Thus, the internal resistance of the PTC thermistors 23 and 25 increases to relatively high value. Since PTC thermistors 23 and 25 are connected in series to the demagnetizing coil 6, the resistances of the PTC thermistors 23 and 25 effect on the demagnetizing current additionally. However, since each of the PTC thermistors 23 and 25 increases its resistance rapidly, the rate of attenuation of the demagnetizing current is not merely doubled, when compared with the the PTC thermistor device of FIG. 3, but is improved to a higher value. In other words, the employment of two PTC thermistors 23 and 25 in the path of demagnetizing current in association with the center PTC thermistor 21 has, when compared with only one PTC thermistor in the demagnetizing current path (FIG. 4), a synergistic effect on the attenuation of demagnetizing current. This is apparent from the chart 2 shown below.

CHART 2

Figure 4:
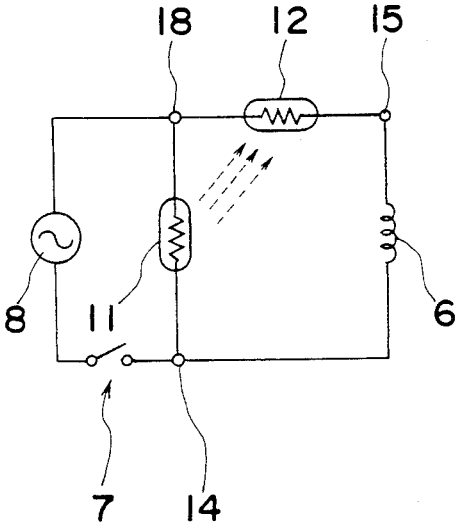
Fig. 4 Prior Art
FIG. 4 is a circuit diagram showing an demagnetizing circuit employing the device of FIG. 3.
Figure 5:
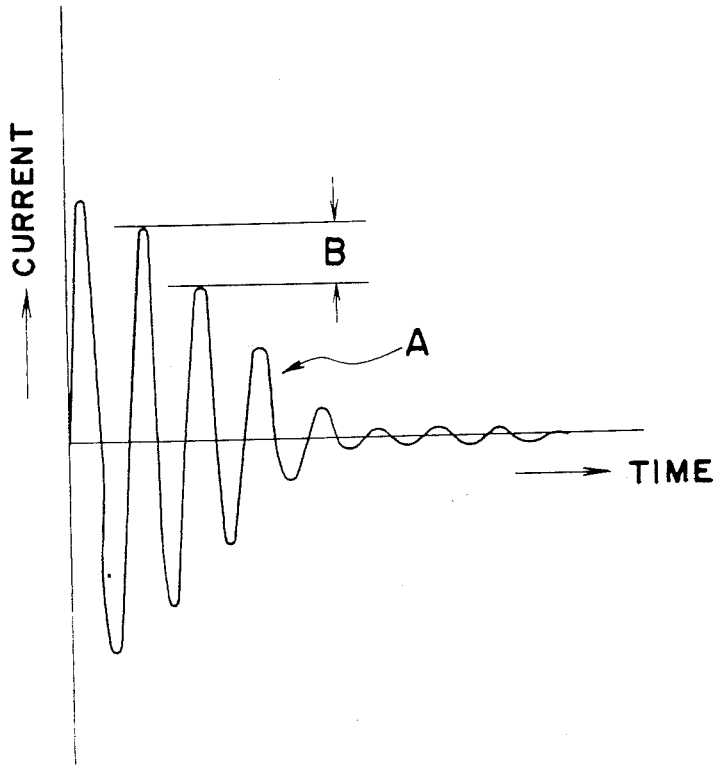
FIG. 5 is a graph showing a waveform of a demagnetizing current, in which abscissa and ordinate represent time and current, respectively.

| | Initial current | Current 3 sec. later | Current 3 min. later | Current difference between 2 peaks |
|---|---|---|---|---|
| FIG. 4 circuit | 10 A | 25 mA | 2 mA | 2.5 A |
| FIG. 7 circuit | 10 A | 5 mA | 0.2 mA | 1.2 A |

As apparent from the above chart 2, the demagnetizing current according to the present invention is attenuated to a level 1/5 of the demagnetizing current according to the prior art at a moment 3 seconds after the turning on of the switch 7, and to a level 1/10 at a moment 3 minutes after the turning on of the switch 7. Furthermore, as apparent from the chart 2, last column, a current difference between 2 neighboring peaks is reduced from 2.5 A (in the case of circuit of FIG. 4) to 1.2 A, which is less than a half. Therefore, the demagnetization is effectively carried out by the use of PTC thermistor device of the present invention.

Although the above results in the chart 2 are obtained when the demagnetizing power is a.c. 100 volts, it has been found that a similar excellent effect is obtained for the circuit of the present invention when the power is reduced approximately to half. This takes an advantage not only in the energy saving, but also increases the life time of the PTC thermistor device.

Although the present invention has been fully described with reference to a preferred embodiment, many modifications and variations thereof will now be apparent to those skilled in the art, and the scope of the present invention is therefore to be limited not by the details of the preferred embodiment described above, but only by the terms of appended claims.

What is claimed is:

1. A PTC thermistor device for use in a demagnetizing circuit, said demagnetizing device comprising:

a first PTC thermistor having first and second flat faces;

first and second terminal plates held in contact with said first and second faces of the first PTC thermistor, respectively, said first and second terminal plates including leg portions adapted to be connected across an A.C. power source;

a second PTC thermistor having first and second flat faces, said first flat face of the second PTC thermistor being held in contact with said first terminal plate such that the first terminal plate is sandwiched between the first and second PTC thermistors;

a third PTC thermistor having first and second flat faces, said first flat face of the third PTC thermistor being held in contact with said second terminal plate such that the second terminal plate is sandwiched between the first and third PTC thermistors;

a first lead terminal member connected to said second flat face of said second PTC thermistor;

a second lead terminal member connected to said second flat face of said third PTC thermistor, said first and second lead terminal members adapted to be connected to respective ends of a demagnetizing coil;

means for holding said first, second, third PTC thermistors and said first and second terminal plates together with said second and third thermistors sandwiching said first thermistor, said holding means including respective spring means formed at the end of each of said first and second lead terminal members; and a casing which houses said thermistors, said terminal plates, said terminal members and said spring means.

2. A PTC thermistor device as claimed in claim 1, wherein said spring means is defined by first and second terminal members having their ends connected to the second and third PTC thermistors, respectively, so bent as to present a spring effect.

3. A PTC thermistor device as claimed in claim 1, wherein said leg portions extend outwardly from said casing for an external connection with said power source.

4. A PTC thermistor device as claimed in claim 3, wherein each of said first and second lead terminal members have a portion extending outwardly from said casing for an external connection with said a.c. power source.

5. A PTC thermistor device as claimed in claim 1, wherein each of said first and second terminal plates is formed by a material having a high thermal conductivity.

6. A PTC thermistor device as claimed in claim 1, wherein each of said first and second terminal members is formed by a material having a low thermal conductivity.

7. The PTC thermistor device of claim 1, further including a demagnetizing coil, opposite ends of which are connected to said first and second lead terminal members respectively and an A.C. power source having first and second terminals connected to said leg portions of said first and second terminal plates, respectively.

* * * * *